US008357485B2

(12) United States Patent
Haller et al.

(10) Patent No.: US 8,357,485 B2
(45) Date of Patent: Jan. 22, 2013

(54) COLOR MOTION PICTURE PRINT FILMS

(75) Inventors: Christopher J. Haller, Rochester, NY (US); Daniel R. May, Brockport, NY (US); Paul L. Zengerle, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 80 days.

(21) Appl. No.: 12/910,934

(22) Filed: Oct. 25, 2010

(65) Prior Publication Data

US 2012/0100485 A1 Apr. 26, 2012

(51) Int. Cl.

| | |
|---|---|
| ***G03C 1/005*** | (2006.01) |
| ***G03C 1/494*** | (2006.01) |
| ***G03C 7/46*** | (2006.01) |
| ***G03C 1/46*** | (2006.01) |
| ***G03C 7/00*** | (2006.01) |

(52) U.S. Cl. ..... 430/567; 430/934; 430/543; 430/506; 430/503; 430/502; 430/496; 430/377; 430/376; 430/375; 430/374; 430/364; 430/363; 430/357

(58) Field of Classification Search ..... 430/357, 430/363, 364, 374–377, 496, 502, 503, 506, 430/543, 567, 934

See application file for complete search history.

(56) References Cited

U.S. PATENT DOCUMENTS

| | | | |
|---|---|---|---|
| 6,558,885 | B1 | 5/2003 | Sakai et al. |
| 6,913,874 | B2 | 7/2005 | Haller et al. |
| 7,153,640 | B1 | 12/2006 | Zengerle et al. |
| 7,223,529 | B1 | 5/2007 | Zengerle et al. |
| 7,629,112 | B1 | 12/2009 | Zengerle et al. |
| 7,632,632 | B1 | 12/2009 | Zengerle et al. |

*Primary Examiner* — Geraldina Visconti
(74) *Attorney, Agent, or Firm* — J. Lanny Tucker

(57) ABSTRACT

A multi-color photographic silver halide element has a total gelatin level on the imaging side of the support is less than 9000 mg/m$^2$, and bulk gelatin-to-junk weight ratio for all of the light sensitive layers on the imaging side of the support is greater than 1.5. This weight ratio is defined by:

$$\text{Bulk gelatin-to-junk ratio}=[(B_{gel}\times B_{gel/junk})+(R_{gel}\times R_{gel/junk})+(G_{gel}+G_{gel/junk})]\div(B_{gel}+R_{gel}+G_{gel})$$

wherein $B_{gel}$ is the total gelatin level for blue light sensitive layers, $B_{gel/junk}$ is the gelatin-to-junk ratio for blue light sensitive layers, $R_{gel}$ is the total gelatin level for red light sensitive layers, $R_{gel/junk}$ is the gelatin-to-junk ratio for red light sensitive layers, $G_{gel}$ is the total gelatin level for green light sensitive layers, and $G_{gel/junk}$ is the gelatin-to-junk ratio for green light sensitive layers. The imaging layers can be thinned without undesirable loss in sensitometric properties and in increase in dust and dirt generation while providing reduced material costs and improving development properties.

16 Claims, No Drawings

COLOR MOTION PICTURE PRINT FILMS

FIELD OF THE INVENTION

This invention relates to photographic silver halide materials that are useful to provide color motion picture print films or motion picture projection films. More particularly, it relates to such color motion picture print films having reduced gelatin coverage. This invention also relates to a method of processing the color motion picture print films after they have been imaged.

BACKGROUND OF THE INVENTION

A typical color silver halide photographic material comprises a flexible support with one or more coated layers on both sides, often referred to as an emulsion (imaging) side and the back (non-imaging) side. The back side generally has a conductive, antistatic layer and a scratch resistant top layer to facilitate film transport. The emulsion side generally has at least one layer sensitized to each of the three primary regions of the visible spectrum. They usually contain at least one blue-sensitive layer with a yellow image dye forming coupler, at least one green-sensitive layer with a magenta image dye forming coupler, and at least one red-sensitive layer with a cyan image dye forming coupler. Additional antihalation layers, interlayers, and a topcoat are usually also present on the emulsion side.

In general, it is desirable to reduce the thickness of coated layers as much as possible in photographic materials, especially the silver halide emulsion light-sensitive layers since they contain the most gelatin, silver halide emulsion grains, image coupler dispersion particles, and other photographic addenda. The image coupler dispersion particles generally also contain one or more high boiling, permanent organic coupler solvents as described for example in U.S. Pat. No. 2,322,027 (Jelley et al.).

Thinning of such layers can be achieved by reducing the amount of gelatin binders or by lowering the amount of other incorporated components, commonly known in the photographic industry as "junk". Since gelatin is usually present as the binder for all of the other components in the layers, an important metric used to guide film formulators is the "gel to junk" ratio (or "gelatin-to-junk" ratio).

It can be useful to reduce coupler solvents to reduce gelatin coverage. One approach for doing this is to use specific yellow or magenta minimum density dyes as described for example in U.S. Pat. Nos. 7,629,112 (Zengerle et al.) and 7,632,632 (Zengerle et al.). In addition to reducing the cost of materials, thinning the light-sensitive layers is desirable for a number of reasons that are described in the prior art. For example, thinner layers can provide improved sharpness in the final photographic image due to reduced image scattering during exposure as described for example U.S. Pat. Nos. 5,891,613 (Zengerle et al.) and 6,544,724 (Satoh et al.). Reduction in the layer thickness can also lead to lower replenishment rates of processing solutions and an increase in development speed due to shorter diffusion paths throughout the multilayer structure of the imaged photographic material. Improved abrasion resistance can also be obtained with reduced coupler solvent levels in the cyan imaging layers as described in U.S. Pat. No. 7,223,529 (Zengerle et al.). The use of specific alcoholic coupler solvents to increase coupler reactivity (for example cyan coupler reactivity) in order to minimize coated levels of silver halide, image coupler dispersion particles, and gelatin to lower material costs in color print motion picture films is described for example in U.S. Pat. No. 7,153,640 (Zengerle et al.).

Since color motion picture print films are greatly magnified during their projection in theaters, it is important to avoid the dust and the generation of dirt during film manufacture and finishing operations as well as during handling and use in theaters. Undesired static charge build-up can occur when the films are transported on rewind equipment or through projectors. High static charges can attract dirt particles to the film surface. Debris generated during these operations that is deposited onto the film surfaces can cause defects that, if sufficiently large, can be seen on the projected film images. Thus, a great deal of work has been done in the industry to minimize dirt and dust generation of the back side of such films. In addition, efforts have been made to improve scratch resistance on the back side of the films, and to improve lubricity so that transport through projectors generates minimal dust.

Color motion picture print films having improved protective outer layers are described in U.S. Pat. No. 6,913,874 (Haller et al.). However, there is little description of efforts in the industry to minimize dirt and dust generation on the emulsion side of color motion picture print films.

It is desired to reduce the coated dry thickness of emulsion layers on the emulsion side of the color motion picture print films in order to reduce material costs, to increase the speed of development, and to reduce the replenishment rates of processing solutions. Since gelatin is a major component of such layers and contributor to layer thickness, it would be desirable to reduce the gelatin coverage in as many layers as possible. However, if too much gelatin is removed, dirt and dust generation increases during manufacturing, especially in film finishing during slitting and spooling operations. Thus, there is a need for a way to reduce the layer thickness while maintaining or lowering contamination from dust and dirt during manufacturing operations. It would also be desirable to provide color motion picture print films that enable more rapid development and reduced development replenishment rates, both of which will reduce the costs to the film processor and ultimately to the film user.

SUMMARY OF THE INVENTION

The present invention provides a color photographic silver halide element comprising a support, and having on an imaging side thereof, in order:

at least one blue light sensitive layer, at least one red light sensitive layer, and at least one green light sensitive layer, provided that the total gelatin level on the imaging side of the support is less than 9000 mg/m$^2$, and the bulk gelatin-to-junk weight ratio for all of the light sensitive layers on the imaging side of the support is greater than 1.5, wherein the bulk gelatin-to-junk weight ratio is defined by the following equation:

$$\text{Bulk gelatin-to-junk ratio}=[(B_{gel}\times B_{gel/junk})+(R_{gel}\times R_{gel/junk})+(G_{gel}+G_{gel/junk})]\div(B_{gel}+R_{gel}+G_{gel})$$

wherein $B_{gel}$ is the total gelatin level for all blue light sensitive layers, $B_{gel/junk}$ is the gelatin-to-junk ratio for all blue light sensitive layers, $R_{gel}$ is the total gelatin level for all red light sensitive layers, $R_{gel/junk}$ is the gelatin-to-junk ratio for all red light sensitive layers, $G_{gel}$ is the total gelatin level for all green light sensitive layers, and $G_{gel/junk}$ is the gelatin-to-junk ratio for all green light sensitive layers.

In some embodiments of this invention a color silver halide photographic element comprises a support having thereon, in order, on the imaging side:

an antihalation layer, a yellow dye image forming unit comprising at least one blue light sensitive silver halide layer having associated therewith at least one yellow dye forming color coupler, a cyan dye image forming unit comprising at least one red light sensitive silver halide layer having associated therewith at least one cyan dye forming color coupler, a magenta dye image forming unit comprising at least one green light sensitive silver halide layer having associated therewith at least one magenta dye forming color coupler, and an outermost protective layer, and on the back side of the support, an antistatic layer and an outermost protective layer.

This invention also provides a method of producing a color motion picture print film comprising:

A) imagewise exposing the color photographic silver halide element of this invention to form a latent color positive image, and B) processing the imagewise exposed element in an alkaline processing solution containing a color developing agent, to form a color positive image in a color motion picture print film.

The color photographic silver halide elements of this invention are particularly useful as color motion picture print films that can be projected in theaters. Such elements can also have conventional antihalation layers, interlayers, and an outermost protective layer on the imaging side of the support, and an antistatic layer and outermost protective layer on the back side of the support.

We found that when the amounts of gelatin and "junk" in the various imaging layers on the imaging side meet the noted bulk gelatin-to-junk ratio equation, that is, the bulk gel-to-junk weight ratio is greater than 1.5, the light sensitive imaging layers can be thinned without undesirable loss in sensitometric properties and an increase in dust and dirt generation while providing reduced material costs and improving development properties (increased development rate and reduced replenishment rate). These advantages require a careful balancing of the amount of gelatin and "junk" in the noted blue, green, and red light sensitive layers while keeping the total gelatin coverage on the imaging side to less than 9000 mg/m$^2$.

DETAILED DESCRIPTION OF THE INVENTION

Definitions

By "junk", we mean to refer to all organic materials incorporated into a given light-sensitive layer, or combination of light-sensitive layers, except the gelatin binder(s). These incorporated materials include but are not limited to, image-forming couplers, permanent coupler solvents, stabilizers, dyes, and oxidized developer scavengers. The silver halide grains are considered "junk" in the present invention. The "junk" level for a given layer is calculated by adding the coated amounts of all light sensitive emulsions (in mg/m$^2$) in the layer and dividing that number by three, and then adding together the coated levels of the organic compounds (other than gelatin) in the layer (in mg/m$^2$) to arrive at the total "junk" level (in mg/m$^2$) for that layer. In other words, the silver halide in the layer is considered ⅓ of the weight of all of the organic materials (other than gelatin) in the layer.

Unless otherwise noted, the terms "photographic element", "photographic film", "color photographic silver halide element", "color motion picture print film", and "multicolor photographic element" are intended to refer to the present invention.

Unless otherwise specifically stated, use of the term "substituted" or "substituent" in defining the magenta dyes means any group or atom other than hydrogen. Additionally, when the term "group" is used, it means that when a substituent group contains substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group can be halogen or can be bonded to the remainder of the molecule by an atom of carbon, silicon, oxygen, nitrogen, phosphorous, or sulfur. The substituent can be, for example, halogen (such as chlorine, bromine, or fluorine), nitro, hydroxyl, cyano, carboxyl, or groups which can be further substituted, such as alkyl, including straight or branched chain or cyclic alkyl, such as methyl, trifluoromethyl, ethyl, t-butyl, 3-(2,4-di-t-pentylphenoxy) propyl, and tetradecyl, alkenyl (such as ethylene and 2-butene), alkoxy (such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy), aryl (such as phenyl, 4-t-butylphenyl, 2,4,6-trimethylphenyl, and naphthyl), aryloxy (such as phenoxy, 2-methylphenoxy, alpha- or beta-naphthyloxy, and 4-tolyloxy), carbonamido (such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which can be substituted and that contains a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl, quaternary ammonium (such as triethylammonium), and silyloxy (such as trimethylsilyloxy).

If desired, the substituents can themselves be further substituted one or more times with the described substituent groups. The particular substituents used can be selected by those skilled in the art to attain the desired photographic properties for a specific application and can include, for example, hydrophobic groups, solubilizing groups, blocking groups, releasing or releasable groups, etc. When a molecule can have two or more substituents, the substituents can be joined together to form a ring such as a fused ring unless otherwise provided. Generally, the above groups and substituents thereof can include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it can be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include but are not limited to, alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Color Photographic Silver Halide Elements

The color photographic silver halide elements of this invention are multicolor elements. Such multicolor elements contain image dye-forming units sensitive to each of the three primary regions of the spectrum. Each unit can comprise one or more silver halide emulsion layers sensitive to a given region of the spectrum. The layers of the elements, including the layers of the image-forming units, can be arranged in a specific order for color motion picture films, namely, the one or more blue light sensitive layers (sensitized to about 380-500 nm) are closest to the support, followed by the one or more red light sensitive layers (sensitized to about 600-760 nm), and then the one or more green light sensitive layers (sensitized to about 500-600 nm).

Thus, a typical multicolor photographic element comprises a support bearing, in order, a yellow dye image-forming unit comprised of at least one blue light sensitive silver halide emulsion layer having associated therewith at least one yellow dye-forming coupler, a cyan dye image-forming unit comprising at least one red light sensitive silver halide emulsion layer having associated therewith at least one cyan dye-forming coupler, and a magenta dye image-forming unit comprising at least one green light sensitive silver halide emulsion layer having associated therewith at least one magenta dye-forming coupler. The element can contain additional layers, such as filter layers, interlayers, outermost protective layers, and subbing layers on either or both sides of the support.

The color-forming couplers are incorporated into the various layers so that during development, they are available in the emulsion layers to react with a color developing agent that is oxidized by silver halide image development. Non-diffusing color-forming couplers are usually incorporated into the layers. Color photographic chemistry can also be used to produce black-and-white images using a combination of non-diffusing color-forming couplers as described for example in WO 1993/012465 (Edwards et al.).

The invention is directed particularly to photographic elements used to produce color motion picture print films designed for exposure through a projection display. The principles by which such elements form color images are described in James, *The Theory of the Photographic Process*, Chapter 12, Principles and Chemistry of Color Photography, pp. 335-372, 1977, Macmillian Publishing Co. (New York), and suitable materials useful for manufacturing the photographic elements are described for example, in *Research Disclosure*, December, 1997, Item 17643; November 1992, Item 34390; September 1994, Item 36544; September 1996, Item 38957, all published by Kenneth Mason Publications, Ltd., Dudley Annex, 12a North Street, Emsworth, Hampshire PO10 7DQ, ENGLAND. The images are formed in the photographic elements by exposure to an original scene in a camera, or can they can be duplicates formed from such a camera or origination materials, for example records formed in color negative intermediate films such as those identified commercially as Eastman Color Intermediate Films™. Alternatively, the original record can be in the form of electronic image data that can be used to control a printer apparatus such as a laser printer, for selective imagewise exposure to form a color motion picture print film.

The color photographic silver halide elements generally comprise relatively small grain, high silver chloride emulsions, that is, emulsions having average grain size defined as cubic edge lengths (CEL) of less than 1 μm and a chloride content greater than 50 mol %, and typically a chloride content greater than 80 mol %, based on total silver in the emulsion. Such elements generally have an ISO speed rating of less than 50 and more likely less than 25.

In the following discussion of suitable materials for use in the emulsions and elements of this invention, reference will be made to *Research Disclosure*, September 1996, Item 38957, noted above, which will be identified hereafter by the term "*Research Disclosure*". The contents of *Research Disclosure*, including the patents and publications referenced therein, are incorporated herein by reference, and the Sections hereafter referred to are Sections of Item 38957.

The color photographic silver halide elements are positive-working Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating image-forming couplers and dyes, including image-forming coupler dispersions in organic solvents, are described in Section X(E). Scan facilitating is described in Section XIV. Supports, exposure techniques, development systems, and processing methods and agents are described in Sections XV to XX.

The various layers of the photographic elements, and especially the emulsion layers, contain one or more gelatin or gelatin derivatives as vehicles and binders. The term "gelatin" is used herein to refer to gelatin and gelatin derivatives that can be naturally occurring or of synthetic origin, and include but are not limited to, phthalated gelatin, alkaline gelatin, acidified gelatin, carboxylated gelatin, recombinant gelatins, and any chemically modified gelatins. Mixtures of gelatins can be used in any of the layers of the photographic elements.

It is also contemplated that the materials and processes described in *Research Disclosure* February 1995, Item 37038 also can be advantageously used with the elements of this invention.

The following discussion relates to image-forming coupling species ("couplers") present in the elements. Coupling-off groups can determine the chemical equivalency of a coupler, i.e., whether it is a 2-equivalent or a 4-equivalent coupler, or modify the reactivity of the coupler. Such groups can advantageously affect the layer in which the image-forming coupler is located, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766, and in GB published applications 1,466,728, 1,531,927, 1,533,039, 2,006,755A and 2,017,704A, the disclosures of which are incorporated herein by reference.

Image-forming couplers that form cyan dyes upon reaction with oxidized color developing agents are described for example, in U.S. Pat. Nos. 2,367,531, 2,423,730, 2,474,293, 2,772,162, 2,895,826, 3,002,836, 3,034,892, 3,041,236, 4,333,999, 4,883,746, and 5,256,526 and "Farbkuppler-eine LiteratureUbersicht," published in Agfa Mitteilungen, Band III, pp. 156-175 (1961). Usually such image-forming couplers are phenols, naphthols, and pyrazolotriazoles that form cyan dyes on reaction with oxidized color developing agent. Other useful cyan dye image-forming couplers are described in U.S. Pat. No. 7,153,640 (Zengerle al.) that is incorporated herein by reference.

Image-forming couplers that form magenta dyes upon reaction with oxidized color developing agent are described in U.S. Pat. Nos. 2,311,082, 2,343,703, 2,369,489, 2,600,788, 2,908,573, 3,062,653, 3,152,896, 3,519,429, 3,758,309, and 4,540,654, and "Farbkuppler-eine LiteratureUbersicht," published in Agfa Mitteilungen, Band III, pp. 126-156 (1961). Usually such image-forming couplers are pyrazolones, pyrazolotriazoles, or pyrazolobenzimidazoles that form magenta dyes upon reaction with oxidized color developing agents.

Image-forming couplers that form yellow dyes upon reaction with oxidized and color developing agent are described in U.S. Pat. Nos. 2,298,443, 2,407,210, 2,875,057, 3,048,194, 3,265,506, 3,447,928, 4,022,620, 4,443,536, 4,840,884, 5,447,819, 5,457,004, 5,998,121, 6,132,944, and 6,569,612, and "Farbkuppler-eine LiteratureUbersicht," published in Agfa Mitteilungen, Band III, pp. 112-126 (1961). Such image-forming couplers are typically open chain ketomethylene compounds.

Image-forming couplers that form colorless products upon reaction with oxidized color developing agent are described in GB Patent 861,138 and U.S. Pat. Nos. 3,632,345, 3,928,041, 3,958,993, and 3,961,959. Typically such image-forming couplers are cyclic carbonyl containing compounds that form colorless products on reaction with an oxidized color developing agent.

Image-forming couplers that form black dyes upon reaction with oxidized color developing agent are described in U.S. Pat. Nos. 1,939,231, 2,181,944, 2,333,106, and 4,126,461, German OLS Nos. 2,644,194 and 2,650,764. Typically, such image-forming couplers are resorcinols or m-aminophenols that form black or neutral products on reaction with oxidized color developing agent.

In addition to the foregoing, so-called "universal" or "washout" couplers can be employed. These couplers do not contribute to image dye-formation. Thus, for example, a naphthol having an unsubstituted carbamoyl or one substituted with a low molecular weight substituent at the 2- or 3-position can be employed. Couplers of this type are described, for example, in U.S. Pat. Nos. 5,026,628, 5,151,343, and 5,234,800.

It can be useful to use a combination of image-forming couplers any of which can contain known ballasts or coupling-off groups such as those described in U.S. Pat. Nos. 4,301,235, 4,853,319, and 4,351,897. The image-forming coupler can contain solubilizing groups such as those described in U.S. Pat. No. 4,482,629. The image-forming coupler can also be used in association with "wrong" colored couplers (for example, to adjust levels of interlayer correction) and, in color negative applications, with masking couplers such as those described in EP 213,490, Japanese Published Applications 58-172,647 and 58-113935, U.S. Pat. Nos. 2,983,608, 4,070,191, and 4,273,861, German Applications DE 2,706,117 and 2,643,965, and GB Patent Publication 1,530,272. The masking couplers can be shifted or blocked, if desired.

Typically, image-forming couplers are incorporated into a silver halide light sensitive emulsion layers in a mole ratio to silver of at least 0.05:1 and up to and including 1:1, or typically at least 0.1:1 and up to and including 0.5:1. Usually the image-forming couplers are incorporated as dispersions in one or more hydrophobic organic solvents (sometimes called "permanent" solvents or coupler solvents), such as one or more high-boiling organic solvents, in a weight ratio of organic solvent to image-forming coupler of at least 0.1:1 and up to and including 10:1, and typically of at least 0.1:1 and up to and including 2:1 although dispersions using no organic solvent are sometimes employed.

An image-forming coupler dispersion contains the image-forming coupler in a stable, finely divided state in a hydrophobic organic solvent that is stabilized by suitable surfactants or surface active agents usually in combination with a binder or matrix such as a gelatin. The dispersion can contain one or more hydrophobic organic solvents that dissolve the materials and maintain them in a liquid state. Some examples of suitable hydrophobic organic solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Useful classes of solvents are carbonamides, phosphates, phenols, alcohols, and esters. When a hydrophobic organic solvent is present, it is usual that the weight ratio of coupler to organic solvent be at least 1:0.5, or at least 1:1. The dispersion can contain an auxiliary coupler solvent initially to dissolve the coupler but this solvent is removed afterwards, usually either by evaporation or by washing with additional water. Some examples of suitable auxiliary coupler solvents are ethyl acetate, cyclohexanone and 2-(2-butoxyethoxy)ethyl acetate. The dispersion can also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC, sodium dodecyl benzene sulfonate, and saponin. The image-forming couplers can also be dispersed as an admixture with another component of the system such as an image-forming coupler or an oxidized developer scavenger so that both are present in the same oil droplet. It is also possible to incorporate the image-forming couplers as a solid particle dispersion; that is, a slurry or suspension of finely ground (through mechanical means) compound. These solid particle dispersions can be additionally stabilized with surfactants or polymeric materials as known in the art. Also, additional coupler solvents can be added to the solid particle dispersion to help increase activity.

The term "high boiling organic solvent" is used herein to refer to coupler solvents having a boiling point above about 150° C. Such coupler solvents have sufficient carbon atoms so that they have a sufficient molecular weight to prevent excessive solvent migration between layers in the element. The coupler solvents are also liquids at 37° C. that is a typical processing (development) temperature. Particularly useful high boiling organic solvents include tricresylphosphate, N,N-diethyllauramide, N,N-dibutyllauramide, p-dodecylphenol, dibutylphthalate, di-n-butyl sebacate, 2-hexyl-1-decanol, tri(2-ethylhexyl)phosphate, 2,4-di-t-pentylphenol, and triphenylphosphate As noted above, the photographic elements exhibit certain advantages in view of the fact that the bulk gelatin-to-junk ratio for all of the light sensitive layers on the imaging side of the support is greater than 1.5 or typically greater than 1.7. The bulk gelatin-to-junk weight ratio is defined by the following equation:

$$\text{Bulk gelatin-to-junk ratio}=[(B_{gel}\times B_{gel/junk})+(R_{gel}\times R_{gel/junk})+(G_{gel}+G_{gel/junk})]\div(B_{gel}R_{gel}+G_{gel})$$

wherein $B_{gel}$ is the total gelatin level for all blue light sensitive layers, $B_{gel/junk}$ is the gelatin-to-junk ratio for all blue light sensitive layers, $R_{gel}$ is the total gelatin level for all red light sensitive layers, $R_{gel/junk}$ is the gelatin-to-junk ratio for all red light sensitive layers, $G_{gel}$ is the total gelatin level for all green light sensitive layers, and $G_{gel/junk}$ is the gelatin-to-junk ratio for all green light sensitive layers. In addition, the total gelatin level on the imaging side of the support is less than 9000 mg/m$^2$, or typically less than 8000 mg/m$^2$, or at least 6000 and up to and including 8000 mg/m$^2$, with at least 7000 and up to and including 8000 mg/m$^2$ being most useful.

In some embodiments, the color photographic silver halide element has a blue light sensitive layer comprising high silver chloride grains having a CEL value of less than 1 μm, a red light sensitive layer comprising high silver chloride grains having a CEL of less than 0.5 μm, and a green light sensitive layer comprising high silver chloride grains having a CEL of less than 0.5 μm.

Moreover, the color photographic silver halide element can have a blue light sensitive layer comprising silver chlorobromide, silver chloroiodide, or silver chlorobromoiodide grains having at least 99 mol % chloride, based on total silver, and a CEL of less than 0.5 μm, a red light sensitive layer comprising silver chlorobromide, silver chloroiodide, or silver chlorobromoiodide grains having at least 99 mol % chloride, based on total silver, and a CEL of less than 0.25 μm, and a green light sensitive layer comprising silver chlorobromide, silver chloroiodide, or silver chlorobromoiodide grains having at least 99 mol % chloride, based on total silver, chloride and a CEL of less than 0.25 μm.

It is also desired that the gelatin level in all blue light sensitive layers on the imaging side be less than 3500 mg/m$^2$, the gelatin level in all red light sensitive layers on the imaging side be less than 3500 mg/m$^2$, and the gelatin level in all green light sensitive layers on the imaging side be less than 2000 mg/m$^2$.

In addition, the yellow color coupler level in all blue light sensitive layers on the imaging side can be less than 1000 mg/m$^2$, the cyan color coupler level in all red light sensitive layers on the imaging side can be less than 900 mg/m$^2$, and the magenta color coupler level in all green light sensitive layers on the imaging side can be less than 800 mg/m$^2$.

The invention elements can include materials that accelerate or otherwise modify the processing steps e.g. of bleaching or fixing to improve the quality of the image. Bleach accelerator releasing couplers such as those described in EP 193,389 and 301,477, and U.S. Pat. Nos. 4,163,669, U.S. Pat. No. 4,865,956, and U.S. Pat. No. 4,923,784, can be useful. Also contemplated is the use of compositions in association with nucleating agents, development accelerators or their precursors (GB Patents 2,097,140 and 2,131,188), electron transfer agents (U.S. Pat. Nos. 4,859,578 and 4,912,025), antifogging and anti color-mixing agents such as derivatives of hydroquinones, aminophenols, amines, gallic acid, catechol, ascorbic acid, hydrazides, sulfonamidophenols, and non color-forming couplers.

The color photographic silver halide elements can also include filter dye layers comprising colloidal silver sol or yellow, cyan, and/or magenta filter dyes, either as oil-in-water dispersions, latex dispersions or as solid particle dispersions. Additionally, they can be used with "smearing" couplers (as described in U.S. Pat. Nos. 4,366,237, 4,420,556, and 4,543,323 and EP 96,570).

A compound such as a coupler can release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (see U.S. Pat. Nos. 4,409,323, 4,421,845, and 4,861,701, Japanese Published Applications 57-188035; 58-98728; 58-209736; and 58-209738); groups that function as a coupler or reducing agent after the coupler reaction (U.S. Pat. Nos. 4,438,193 and 4,618,571) and groups that combine the features described above.

The timing or linking groups can also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612 and 523,451, U.S. Pat. No. 4,146,396, and Japanese Kokai 60-249148 and 60-249149.

Moreover, speed enhancing materials such as those described in U.S. Pat. Nos. 6,455,242, 6,426,180, 6,350,564, and 6,319,660 can be used.

Unless indicated otherwise, compounds used directly in a photographic element can be added to a mixture containing silver halide before coating or, more suitably, be mixed with the silver halide just prior to or during coating. In either case, additional components like image-forming couplers, doctors, surfactants, hardeners, and other materials that are typically present in such solutions can also be present at the same time.

The silver halide used in the color photographic silver halide elements has at least 50 mole % chloride based on the total silver. The silver halide grains can also include iodide and bromide, but in most embodiments, the amount of chloride is at least 80 mol %, or at least 95 mol %, with most of the remaining halide being bromide or iodide, based on total silver. The amount of bromide or iodide is generally less than 1 mole %, based on total silver.

The silver halide grains to be used in the invention can be prepared according to methods known in the art, such as those described in *Research Disclosure* publications noted above and *The Theory of the Photographic Process*, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

The emulsion grains in all of the layers tend to be "fine grain" emulsions. Such grains can take any regular shape such as cubic, octahedral, or cubo-octahedral (for example tetradecahedral) grains, or the grains can take other shapes attributable to ripening, twinning, and screw dislocations. Typically, the element grains are bounded primarily by {100} crystal faces since such grain faces are exceptionally stable. Specific examples of high silver chloride emulsions useful in the elements are described in U.S. Pat. Nos. 4,865,962, 5,252,454, 5,252,456, and 5,550,013, all of which are incorporated herein by reference.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by U.S. Pat. Nos. 5,176,991, 5,176,992, 5,221,602, 5,298,387 and 5,298,388, the disclosures of which are here incorporated by reference.

Useful high chloride tabular grain emulsions are {100} tabular grain emulsions, as illustrated by the following patents, herein incorporated by reference: U.S. Pat. Nos. 5,264,337, 5,292,632, 5,275,930, 5,607,828 and 5,399,477 (all Maskasky), U.S. Pat. No. 5,320,938 (House et al.), U.S. Pat. No. 5,314,798 (Brust et al.), U.S. Pat. No. 5,356,764 (Szajewski et al.), U.S. Pat. Nos. 5,413,904, 5,663,041, and 5,744,297 (all Chang et al.), U.S. Pat. No. 5,451,490 (Budz et al.), U.S. Pat. No. 5,695,922 (Reed et al.), U.S. Pat. No. 5,593,821 (Oyamada), U.S. Pat. Nos. 5,641,620 and 5,652,088 (both Yamashita et al.), U.S. Pat. No. 5,652,089 (Saitou et al.), and U.S. Pat. No. 5,665,530 (Oyamada et al.). Ultrathin high chloride {100} tabular grain emulsions can be prepared by nucleation in the presence of iodide, following the teaching of House et al and Chang et al, cited above.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions. Especially useful dopants are disclosed by U.S. Pat. Nos. 4,937,180 (Machetti et al.), 5,164,292 (Johnson et al.), 5,597,686 (MacIntyre et al.), and 5,792,601 (Edwards et al.). In addition it is possible to dope the grains with transition metal hexacoordination complexes containing one or more organic ligands as taught in U.S. Pat. No. 5,360,712 (Olm et al.).

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736, November 1994. SET dopants are known to be effective to reduce reciprocity failure. The use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in U.S. Pat. No. 4,933,272 (McDugle et al.).

Imaging and Development

The photographic elements can be exposed to actinic radiation, typically in the visible region of the spectrum, to form a latent image and can then be processed to form a visible positive dye image. Processing to form a visible dye image includes the step of contacting the element with a color developing agent to reduce developable silver halide and oxidize the color developing agent. Oxidized color developing agent in turn reacts with the color-forming coupler to yield a dye.

With processing step, the imaged photographic element of this invention provides a positive image using a process such as the Kodak ECP-2D process described in the H-24.09 Manual for Processing Eastman Color films, which is available from Eastman Kodak Company. Color print development times are typically 90 seconds or less and desirably they are 45 or even 30 seconds or less.

Useful color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying. Useful solutions useful for each of these steps are known to a skilled worker in the photographic art.

The present invention provides at least the following embodiments and combinations thereof, but other combinations of features are considered to be within the present invention as a skilled artisan would appreciate from the teaching of this disclosure:

The following Examples are provided to illustrate the practice of this invention and are not meant to be limiting in any manner.

Comparative Examples 1-5 and Invention Example 1

Each of several color motion picture films was prepared by coating the following multilayer film structure, in order, on a transparent poly(ethylene terephthalate) support having an antistatic layer and a polyurethane protective layer coated on the back side of the support.

| | mg/m$^2$ |
|---|---|
| Layer 1: | |
| Dye-1 | 122.6 |
| Dye-2 | 56.0 |
| Gelatin | 759 |
| Layer 2: | |
| Blue-sensitive emulsion 1 (3D 0.34 μm, $AgCl_{.995}I_{.005}$, having sensitizing Dye-1 and sensitizing Dye-2) | 112.6 |
| Blue-sensitive emulsion 2 (3D 0.24 μm, $AgCl_{.995}I_{.005}$, having sensitizing Dye-1 and sensitizing Dye-2) | 368.2 |
| Blue-sensitive emulsion 3 (3D 0.27 μm, $AgCl_{.996}Br_{.004}$, having sensitizing dye-1 and sensitizing dye-2) | 260.2 |
| Coupler Y-1 | 1800 |
| Dye-3 | 21.3 |
| Dye-4 | 21.3 |
| Dye-5 | 10.5 |
| CS-4 | 29.8 |
| Gelatin | 2964 |
| Layer 3: | |
| Chem-1 | 15.0 |
| CS-1 | 22.5 |
| Gelatin | 1060 |
| Layer 4: | |
| Red-sensitive emulsion 1 (3D 0.22 μm, $AgCl_{.991}Br_{.009}$, having sensitizing Dye-3) | 67.8 |
| Red-sensitive emulsion 2 (3D 0.15 μm, $AgCl_{.991}Br_{.009}$, having sensitizing Dye-3) | 185.2 |
| Red-sensitive emulsion 3 (3D 0.12 μm, $AgCl_{.990}Br_{.010}$, having sensitizing Dye-3) | 322.1 |
| Coupler C-1 | 1067.6 |
| CS-2 | 85.4 |
| CS-3 | 341.6 |
| Dye-6 | 90.8 |
| Gelatin | 3231 |
| Layer 5: | |
| Chem-1 | 15.0 |
| CS-1 | 22.5 |
| CS-4 | 53.0 |
| Gelatin | 530 |
| Layer 6: | |
| Green-sensitive emulsion 1 (3D 0.22 μm, $AgCl_{.987}Br_{.013}$, having sensitizing Dye-4 and sensitizing Dye-5) | 87.5 |
| Green-sensitive emulsion 2 (3D 0.15 μm, $AgCl_{.987}Br_{.013}$, having sensitizing Dye-4 and sensitizing Dye-5) | 146.5 |
| Green-sensitive emulsion 3 (3D 0.12 μm, $AgCl_{.982}Br_{.018}$, having sensitizing Dye-4 and sensitizing Dye-5) | 400.0 |
| Coupler M-1 | 851 |
| CS-4 | 170.2 |
| Chem-1 | 6.5 |

-continued

| | mg/m$^2$ |
|---|---|
| CS-1 | 9.8 |
| Dye-7 | 82.5 |
| Gelatin | 1880 |
| Layer 7: | |
| Polydimethylsiloxane | 16.5 |
| Carnauba wax | 60.0 |
| Gelatin | 876 |

The above coatings further contained sequestering agents, antifoggants, surfactants, antistatic agent, and matte beads as are known in the art, and hardener at 1.49% of total gelatin.

Using the amounts described above, the bulk gelatin-to-junk ratio for Comparative Element 1 was calculated as follows:

Only one-third of the silver halide was counted as junk, while all of the organic compounds in the imaging layer were considered to be junk. For example for layer 2, the coated levels of the blue light sensitive silver halide emulsions were added together and divided by three, then the levels of all organic compounds (couplers, solvents, dyes, etc.) were also added together to arrive at the total junk level (in mg/m$^2$) for that layer. The total gelatin level for layer 2 was then divided by the total junk level to arrive at the gelatin-to-junk ratio for that layer. The red sensitive emulsion layer (layer 4) and the green sensitive emulsion layer (layer 6) were calculated similarly. The bulk gelatin-to-junk ratio for Comparative Example 1 was then calculated according to the equation described above.

Dye-1

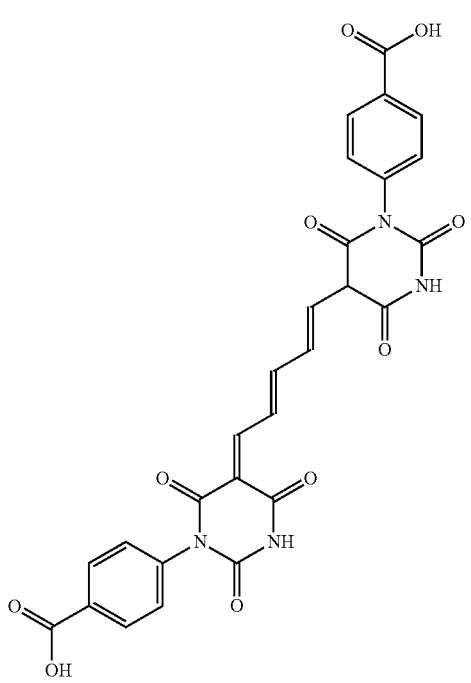

-continued
Dye-2
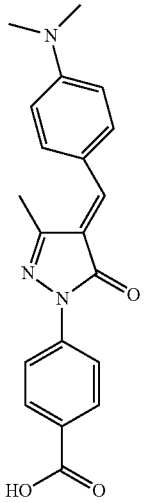
Dye-3
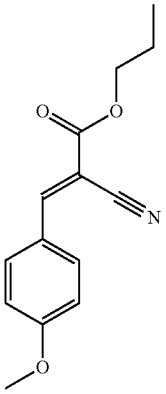
Dye-4
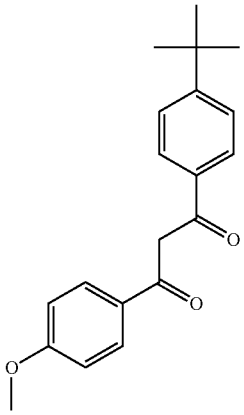
-continued
Dye-5
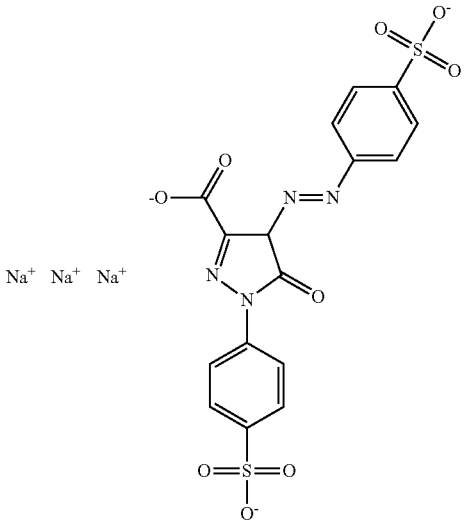
Dye-6
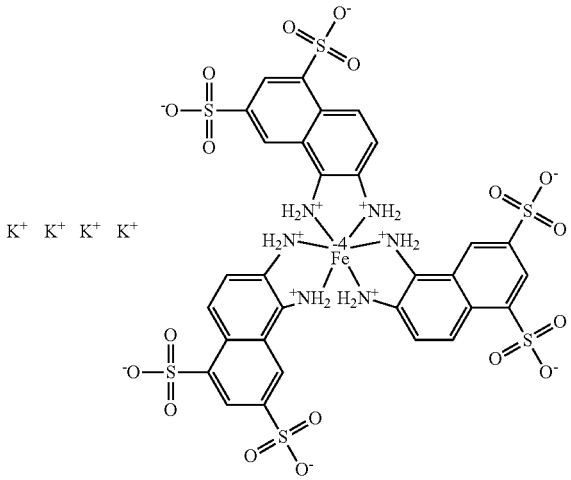
Dye-7
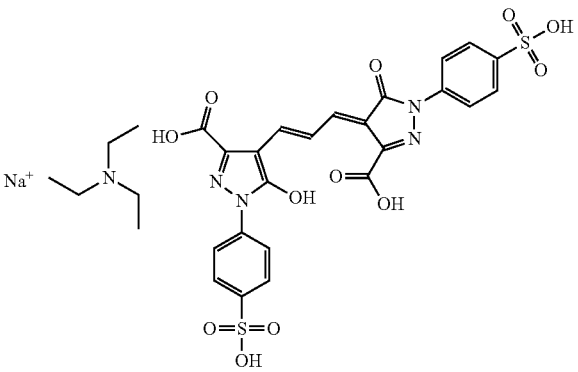

-continued
Dye-8
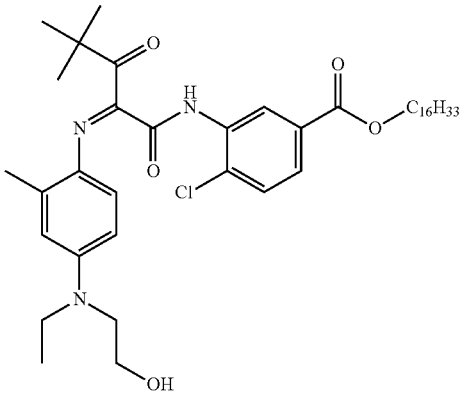
Sensitizing Dye-1
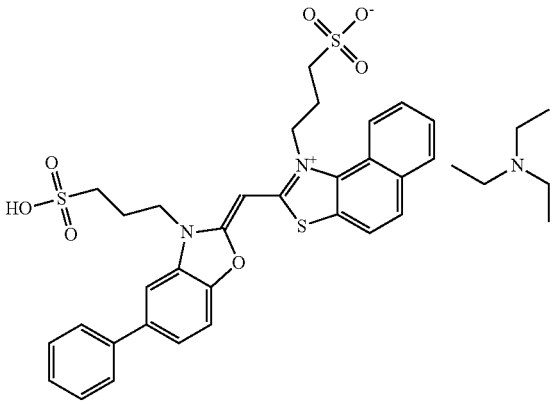
Sensitizing Dye-2
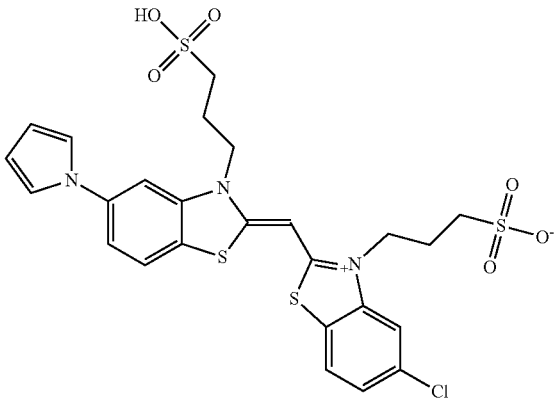
-continued
Sensitizing Dye-3
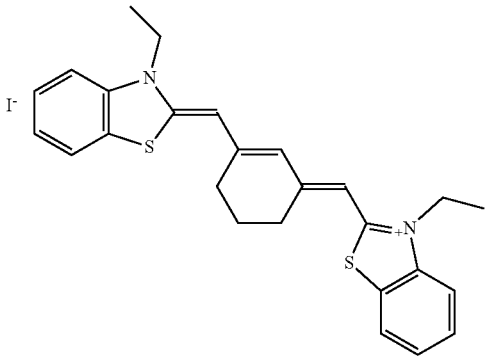
Sensitizing Dye-4
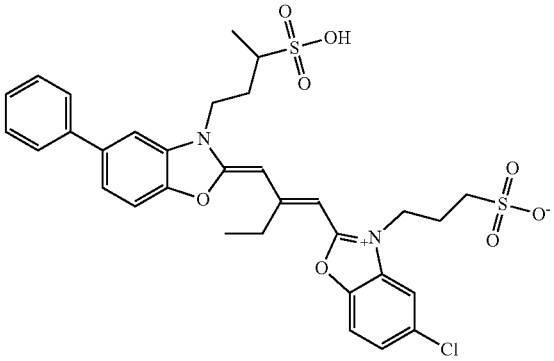
Sensitizing Dye-5
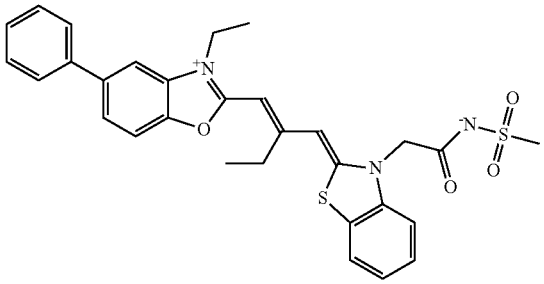
Chem-1
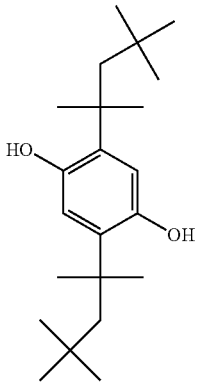

-continued

Coupler Y-1

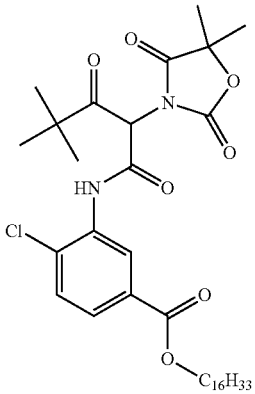

Coupler Y-2

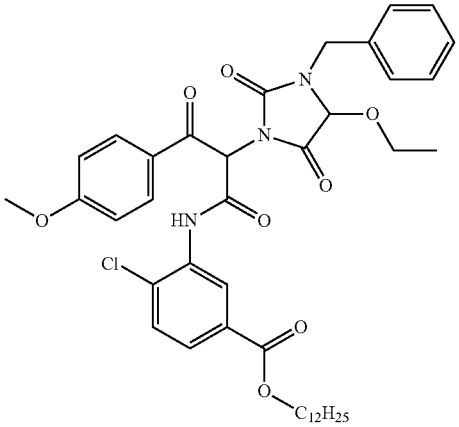

Coupler C-1

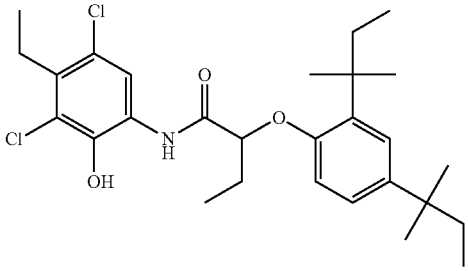

-continued

Coupler M-1

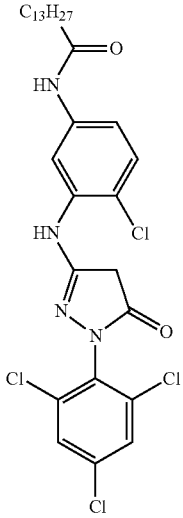

CS-1

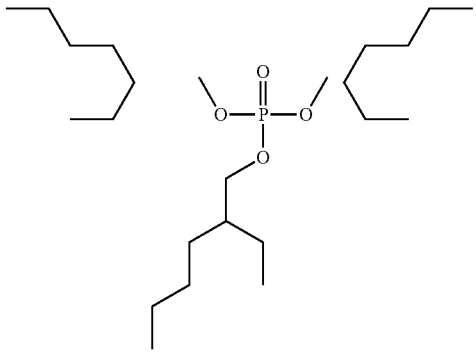

CS-2

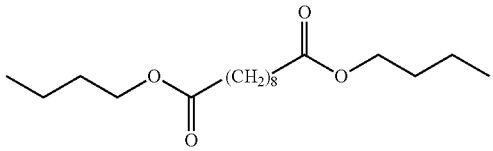

CS-3

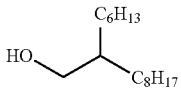

CS-4

Tri-cresylphosphate

Additional variations of Comparative Example 1 were prepared as described below in TABLE I (amounts in mg/m$^2$).

TABLE I

| | | Comparative 2 | Comparative 3 | Comparative 4 | Comparative 5 | Invention 1 |
|---|---|---|---|---|---|---|
| Layer 1 | Dye-1 | 122.6 | 122.6 | 86.0 | 86.0 | 86.0 |
| | Dye-2 | 56.0 | 56.0 | 64.0 | 64.0 | 64.0 |
| | Gelatin | 759.0 | 759.0 | 659.0 | 659.0 | 659.0 |
| Layer 2 | Blue Sensitive Emulsion 1 | 112.6 | 78.2 | 113.2 | 62.0 | 62.0 |
| | Blue Sensitive Emulsion 2 | 368.2 | 380.0 | 329.3 | 331.0 | 331.0 |
| | Blue Sensitive Emulsion 3 | 260.2 | 49.8 | 243.5 | 66.7 | 66.7 |
| | Coupler Y-1 | 1160.0 | 1398.0 | 1161.1 | 890.0 | 560.0 |
| | Coupler Y-2 | — | — | 617.4 | 435.0 | 280.0 |
| | Dye-3 | 21.3 | 20.0 | 21.3 | 20.0 | 20.0 |
| | Dye-4 | 21.3 | 20.0 | 21.3 | 20.0 | 20.0 |

TABLE I-continued

| | | Comparative 2 | Comparative 3 | Comparative 4 | Comparative 5 | Invention 1 |
|---|---|---|---|---|---|---|
| | Dye-5 | 10.6 | 10.9 | 11.0 | 6.0 | 6.0 |
| | CS-4 | 29.8 | 28.0 | 29.8 | 28.0 | 28.0 |
| | Gelatin | 2964.0 | 2454.0 | 2787.0 | 2133.0 | 2133.0 |
| Layer 3 | Gelatin | 1060.0 | 1060.0 | 530.0 | 530.0 | 530.0 |
| Layer 4 | Red Sensitive Emulsion 1 | 67.8 | 62.0 | 70.0 | 62.7 | 62.7 |
| | Red Sensitive Emulsion 2 | 185.2 | 287.0 | 191.1 | 290.3 | 290.3 |
| | Red Sensitive Emulsion 3 | 322.1 | 90.0 | 332.4 | 91.0 | 91.0 |
| | Coupler C-1 | 1067.6 | 904.0 | 1098.0 | 905.7 | 620.0 |
| | CS-2 | 85.4 | 72.3 | 87.8 | 72.5 | 49.6 |
| | CS-3 | 341.6 | 289.3 | 351.4 | 289.8 | 198.4 |
| | Dye-6 | 90.8 | 79.6 | 90.8 | 79.6 | 79.6 |
| | Gelatin | 3231.0 | 2570.0 | 2300.0 | 1900.0 | 1900.0 |
| Layer 6 | Green Sensitive Emulsion 1 | 87.5 | 55.0 | 83.6 | 53.2 | 53.2 |
| | Green Sensitive Emulsion 2 | 146.5 | 336.0 | 140.0 | 324.8 | 324.8 |
| | Green Sensitive Emulsion 3 | 400.0 | 89.0 | 383.0 | 86.0 | 86.0 |
| | Coupler M-1 | 680.0 | 650.0 | 851.0 | 650.0 | 455.0 |
| | CS-4 | 136.0 | 130.0 | 170.2 | 130.0 | 91.0 |
| | Chem-1 | 6.5 | 2.4 | 6.5 | 2.4 | 2.4 |
| | CS-1 | 9.8 | 3.6 | 9.8 | 3.6 | 3.6 |
| | Dye-7 | 82.5 | 39.4 | 82.5 | 39.4 | 39.4 |
| | Gelatin | 1880.0 | 1424.0 | 1600.0 | 1210.0 | 1130.0 |
| Layer 7 | Carnauba wax Gelatin | 60.0 | 45.0 | 135.0 | 135.0 | 135.0 |
| Total | Gelatin | 11,300.0 | 9,673.0 | 9,106.0 | 7,662.0 | 7,697.0 |
| | Blue Gelatin-to-Junk Ratio | 1.989 | 1.491 | 1.333 | 1.374 | 1.999 |
| | Red Gelatin-to-Junk Ratio | 1.818 | 1.723 | 1.260 | 1.270 | 1.734 |
| | Green Gelatin-to-Junk Ratio | 1.670 | 1.445 | 1.210 | 1.235 | 1.515 |
| | Bulk Gelatin-to-Junk Ratio | 1.85 | 1.57 | 1.28 | 1.30 | 1.80 |

The coated multilayer elements were slit into 35 mm strips and perforated along both edges and the emulsion side and the back side of the element were each contacted with particle transfer rollers. After running a specified length of slit and perforated film, the particle transfer roller was contacted with tacky tape to clean the rollers and to collect the dust and dirt particles that were transferred to the rollers from the film. The amount of dirt collected on the tape was rated on a scale from 1 to 5, where 1 represented little or no dirt and 5 indicated very high dirt levels. For each film element, many tape samples were evaluated and their average ratings were reported as the mean emulsion side dirt and the mean backside dirt. The amount of airborne dirt generated by the perforating process was quantified by using a particle counter adjacent to the perforator. Many film samples of each film element were assessed and the average particle counts are reported as the mean sprocket dirt. For each element, the total gelatin level in mg/m$^2$, the bulk gelatin-to-junk ratio, the mean emulsion side dirt ratings, the mean back side dirt ratings, and the mean sprocket dirt counts are given below in TABLE II.

TABLE II

| Element | Gelatin Level (mg/m$^2$) | Bulk Gelatin-to-Junk Ratio | Mean Emulsion Dirt | Mean Backside Dirt | Mean Sprocket Dirt |
|---|---|---|---|---|---|
| Comparative 1 | 11300 | 1.61 | 2.50 | 2.08 | 3888 |
| Comparative 2 | 11300 | 1.85 | 2.37 | 2.08 | 3940 |
| Comparative 3 | 9673 | 1.57 | 2.21 | 2.08 | 3424 |

TABLE II-continued

| Element | Gelatin Level (mg/m$^2$) | Bulk Gelatin-to-Junk Ratio | Mean Emulsion Dirt | Mean Backside Dirt | Mean Sprocket Dirt |
|---|---|---|---|---|---|
| Comparative 4 | 9106 | 1.28 | 3.18 | 2.45 | 5267 |
| Comparative 5 | 7662 | 1.30 | 2.50 | 2.16 | 4267 |
| Invention 1 | 7697 | 1.80 | 2.13 | 2.03 | 3292 |

Comparative Examples 1 and 2, having high gelatin levels, exhibited comparable levels of finishing dirt by the three metrics employed (emulsion side dirt, back side dirt, and sprocket dirt). Comparative Example 3, in which the total film gelatin level was reduced significantly while the bulk gelatin-to junk ratio was similar to that for Comparative Example 1, the dirt levels were similar or slightly lower in some instances. However, as the amount of total gelatin was further reduced and the bulk gelatin-to-junk ratio was substantially lowered (Comparative Example 4), a drastic increase in dirt levels was observed by all three metrics. When the gelatin level was greatly reduced and the bulk gelatin-to-junk ratio remained low (Comparative Example 5), the dirt levels were still relatively high. However, when a similar, very low gelatin level was used in combination with a high (over 1.5) bulk gelatin-to-junk ratio (Invention Example 1), a dramatic improvement in finishing dirt was obtained.

Comparative Examples 6-10

Additional color motion picture print films were prepared as described for Comparative Example 1 using the compositions shown below in TABLE III.

TABLE III

| | | Comparative Example 6 | Comparative Example 7 | Comparative Example 8 | Comparative Example 9 | Comparative Example 10 |
|---|---|---|---|---|---|---|
| Layer 1 | Dye-1 | 122.6 | 122.6 | 86.0 | 122.6 | 122.6 |
| | Dye-2 | 56.0 | 56.0 | 56.0 | 56.0 | 56.0 |
| | Gelatin | 759.0 | 759.0 | 600.0 | 759.0 | 759.0 |
| Layer 2 | Blue Sensitive Emulsion 1 | 76.0 | 76.0 | 76.0 | 113.2 | 113.2 |
| | Blue Sensitive Emulsion 2 | 326.3 | 326.3 | 326.3 | 329.3 | 329.3 |
| | Blue Sensitive Emulsion 3 | 44.7 | 44.7 | 44.7 | 243.5 | 243.5 |
| | Coupler Y-1 | 950.0 | 950.0 | 850.0 | 1161.1 | 1161.1 |
| | Coupler Y-2 | 450.0 | 450.0 | 450.0 | 617.4 | 617.4 |
| | Dye-3 | 20.0 | 20.0 | 20.0 | 21.3 | 21.3 |
| | Dye-4 | 20.0 | 20.0 | 20.0 | 21.3 | 21.3 |
| | Dye-5 | 6.0 | 6.0 | 6.0 | 11.0 | 11.0 |
| | CS-4 | 40.0 | 40.0 | 40.0 | 29.8 | 29.8 |
| | Dye-8 | 16.0 | 16.0 | 16.0 | — | — |
| | Gelatin | 2278.0 | 2278.0 | 2078.0 | 2847.0 | 2847.0 |
| Layer 3 | Gelatin | 530.0 | 530.0 | 530.0 | 530.0 | 530.0 |
| Layer 4 | Red Sensitive Emulsion 1 | 63.1 | 63.1 | 63.1 | 70.6 | 70.6 |
| | Red Sensitive Emulsion 2 | 296.5 | 296.5 | 296.5 | 190.0 | 190.0 |
| | Red Sensitive Emulsion 3 | 94.4 | 94.4 | 94.4 | 333.0 | 333.0 |
| | Coupler C-1 | 914.0 | 914.0 | 914.0 | 1098.0 | 1098.0 |
| | CS-2 | 73.1 | 73.1 | 73.1 | 87.8 | 87.8 |
| | CS-3 | 292.5 | 292.5 | 292.5 | 351.4 | 351.4 |
| | Dye-6 | 81.6 | 81.6 | 81.6 | 93.6 | 93.6 |
| | Gelatin | 2569.0 | 2200.0 | 1900.0 | 3256.0 | 2300.0 |
| Layer 6 | Green Sensitive Emulsion 1 | 61.9 | 61.9 | 61.9 | 83.3 | 83.3 |
| | Green Sensitive Emulsion 2 | 327.8 | 327.8 | 327.8 | 140.1 | 140.1 |
| | Green Sensitive Emulsion 3 | 80.3 | 80.3 | 80.3 | 383.2 | 383.2 |
| | Coupler M-1 | 650.0 | 650.0 | 650.0 | 851.0 | 851.0 |
| | CS-4 | 130.0 | 130.0 | 130.0 | 170.2 | 170.2 |
| | Chem-1 | 2.0 | 2.0 | 2.0 | 6.0 | 6.0 |
| | CS-1 | 3.0 | 3.0 | 3.0 | 9.0 | 9.0 |
| | Dye-7 | 40.0 | 40.0 | 40.0 | 82.5 | 82.5 |
| | Gelatin | 1423.0 | 1250.0 | 1250.0 | 1862.0 | 1500.0 |
| Layer 7 | Carnauba wax | 45.0 | 135.0 | 135.0 | 45.0 | 135.0 |
| | Gelatin | 876.0 | 700.0 | 700.0 | 876.0 | 700.0 |
| Total | Gelatin | 8435.0 | 7717.0 | 7058.0 | 10,130.0 | 8636.0 |

Comparative Examples 7-10 were exposed through a 0-3 neutral density 21-step tablet on a Kodak 1B sensitometer with a 3200K light source. After exposure, the films were processed according to the standard Kodak ECP-2D Color Print Development Process (known in the art as the "ECP" process) as described in the Kodak H-24 Manual, "Manual for Processing Eastman Color Motion Picture Films", Eastman Kodak Company, Rochester, N.Y., the disclosure of which is incorporated by reference herein, except that the color development time was shortened from 3 minutes to 60 seconds. The process consisted of a pre-bath (10 seconds), water rinse (20 seconds), color developer (60 seconds), stop bath (40 seconds), first wash (40 seconds), first fix (40 seconds), second wash (40 seconds), bleach (1 minute), third wash (40 seconds), second fix (40 seconds), fourth wash (1 second), final rinse (10 seconds), and then drying with hot air.

The ECP-2D Prebath Contains:

| | |
|---|---|
| Water | 800 ml |
| Borax (decahydrate) | 20.0 g |
| Sodium sulfate (anhydrous) | 100.0 g |
| Sodium hydroxide | 1.0 g |

Water to make 1 liter
pH = 9.25 +/− 0.10 @ 26.7° C.

The ECP-2D Color Developer Contained:

| | |
|---|---|
| Water | 900 ml |
| Kodak Anti-Calcium, No. 4 (40% solution of a pentasodium salt of nitrilo-trimethylene phosphonic acid) | 1.00 ml |

-continued

| | |
|---|---|
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 ml |

Water to make 1 liter
pH = 10.53 +/− 0.05 @ 26.7° C.

The ECP-2D Stop Bath Contained:

| | |
|---|---|
| Water | 900 ml |
| Sulfuric acid (7.0N) | 50.0 ml |

Water to make 1 liter
pH = 0.90 @ 26.7° C.

The ECP-2D Fixer Contained:

| | |
|---|---|
| Water | 800 ml |
| Ammonium thiosulfate (58.0% solution) | 100.0 ml |
| Sodium bisulfate (anhydrous) | 13.0 g |

Water to make 1 liter
pH = 5.00 +/− 0.15 @ 26.7° C.

The ECP-2D Ferricyanide Bleach Contained:

| | |
|---|---|
| Water | 900 ml |
| Potassium ferricyanide | 30.0 g |
| Sodium bromide (anhydrous) | 17.0 g |

Water to make 1 liter
pH = 6.50 +/− 0.05 @ 26.7° C.

The ECP-2D Final Rinse Solution Contained:

| | |
|---|---|
| Water | 900 ml |
| Kodak Photo-Flo 200 ™ Solution | 3.0 ml |

Water to make 1 liter

Processing of the exposed films was carried out using the color developing solution adjusted to 36.7° C. The stopping, fixing, bleaching, washing, and final rinsing solution temperatures were adjusted to 26.7° C.

The optical density due to dye formation was then measured on a densitometer using Status A filters in the densitometer. Dye density was then graphed versus log (exposure) to form the Red, Green, and Blue D-logE characteristic curves of the photographic films. The maximum red density values obtained from these coatings are given below in TABLE IV.

TABLE IV

| Element | Red Sensitive Silver ($mg/m^2$) | Cyan Coupler Level ($mg/m^2$) | Total Gelatin Level ($mg/m^2$) | Status A Red $D_{max}$ |
|---|---|---|---|---|
| Comparative 6 | 454.0 | 914.0 | 8435 | 3.24 |
| Comparative 7 | 454.0 | 914.0 | 7717 | 3.33 |
| Comparative 8 | 454.0 | 914.0 | 7058 | 3.43 |
| Comparative 9 | 593.6 | 1098.0 | 10130 | 3.50 |
| Comparative 10 | 593.6 | 1098.0 | 8636 | 3.67 |

These results clearly illustrate the improved efficiency of color development at shortened development times due to reducing the total gelatin level of the multilayer color motion picture print films. Although Comparative Examples 6-8 contained the same levels of red sensitive silver halide and cyan dye forming coupler, higher Red $D_{max}$ was obtained as the film gelatin level was reduced. Similarly, Comparative Example 10 having reduced gelatin provided higher Red $D_{max}$ than Comparative Example 9.

The invention has been described in detail with particular reference to certain preferred embodiments thereof, but it will be understood that variations and modifications can be effected within the spirit and scope of the invention.

The invention claimed is:

1. A color photographic silver halide element comprising a transparent support having an imaging side and a back side, and having on the imaging side thereof, in order:

one or more blue light sensitive layers, each blue light sensitive layer comprising gelatin or a gelatin derivative and junk consisting of one or more yellow image-forming couplers, one or more permanent coupler solvents, one or more stabilizers, one or more dyes, one or more oxidized developer scavengers, and silver halide grains, one or more red light sensitive layers, each red light sensitive layer comprising gelatin or a gelatin derivative and junk consisting of one or more cyan image-forming couplers, one or more permanent coupler solvents, one or more stabilizers, one or more dyes, one or more oxidized developer scavengers, and silver halide grains, and green light sensitive layers, each green light sensitive layer comprising gelatin or a gelatin derivative and junk consisting of one or more magenta image-forming couplers, one or more permanent coupler solvents, one or more stabilizers, one or more dyes, one or more oxidized developer scavengers, and silver halide grains, provided that the total gelatin level of all blue, red, and green light sensitive layers on the imaging side of the support is less than 9000 $mg/m^2$, and the bulk gelatin-to-junk weight ratio for the total of all of the blue, red, and green light sensitive layers on the imaging side of the support is greater than 1.5, wherein the bulk gelatin-to-junk weight ratio is defined by the following equation:

$$\text{Bulk gelatin-to-junk ratio}=[(B_{gel}\times B_{gel/junk})+(R_{gel}\times R_{gel/junk})+(G_{gel}+G_{gel/junk})]\div(B_{gel}+R_{gel}+G_{gel})$$

wherein $B_{gel}$ is the total gelatin level for all of the one or more blue light sensitive layers, $B_{gel/junk}$ is the gelatin-to-junk ratio for all of the one or more blue light sensitive layers, $R_{gel}$ is the total gelatin level for all of the one or more red light sensitive layers, $R_{gel/junk}$ is the gelatin-to-junk ratio for all of the one or more red light sensitive layers, $G_{gel}$ is the total gelatin level for all of the one or more green light sensitive layers, and $G_{gel/junk}$ is the gelatin-to-junk ratio for all of the one or more green light sensitive layers.

2. The color photographic silver halide element of claim 1 wherein the gelatin-to-junk ratio is greater than 1.7.

3. The color photographic silver halide element of claim 1 wherein the total gelatin level on the imaging side of the support for all of the blue, red, and green light sensitive layers is less than 8000 $mg/m^2$.

4. The color photographic silver halide element of claim 1 comprising on the imaging side of the support, in order from the support:

the one or more blue light sensitive layers, the one or more red light sensitive layers, the one or more green light sensitive layers, and an outermost protective layer.

5. The color photographic silver halide element of claim 1 further comprising on the back side of the support, an antistatic layer and an outermost protective layer.

6. The color photographic silver halide element of claim 1 wherein the one or more blue light sensitive layers comprise high silver chloride grains having a cubic edge length of less than 1 μm, the one or more red light sensitive layers comprise high silver chloride grains having a cubic edge length of less than 0.5 μm, and the green light sensitive layers comprise high silver chloride grains having a cubic edge length of less than 0.5 μm.

7. The color photographic silver halide element of claim 6 wherein the one or more blue light sensitive layers silver chlorobromide, silver chloroiodide, or silver chlorobromoiodide grains having at least 99 mol % chloride, based on total silver, and a cubic edge length of less than 0.5 μm, the one or more red light sensitive layers silver chlorobromide, silver chloroiodide, or silver chlorobromoiodide grains having at least 99 mol % chloride, based on total silver, and a cubic edge length of less than 0.25 μm, and the one or more green light sensitive layers silver chlorobromide, silver chloroiodide, or silver chlorobromoiodide grains having at least 99 mol % chloride, based on total silver, chloride and a cubic edge length of less than 0.25 μm.

8. The color photographic silver halide element of claim 1 wherein the gelatin level in all of the one or more blue light sensitive layers on the imaging side is less than 3500 mg/m$^2$, the gelatin level in all of the one or more red light sensitive layers on the imaging side is less than 3500 mg/m$^2$, and the gelatin level in all of the one or more green light sensitive layers on the imaging side is less than 2000 mg/m$^2$.

9. The color photographic silver halide element of claim 1 wherein the total yellow color coupler level in all of the one or more blue light sensitive layers on the imaging side is less than 1000 mg/m$^2$, the total cyan color coupler level in all of the one or more red light sensitive layers on the imaging side is less than 900 mg/m$^2$, and the total magenta color coupler level in all of the one or more green light sensitive layers on the imaging side is less than 800 mg/m$^2$.

10. The color photographic silver halide element of claim 1 comprising in one or more blue, red, or green sensitive layers, one or more permanent coupler solvents that are selected from the group consisting of tricresylphosphate, N,N-diethyllauramide, N,N-dibutyllauramide, p-dodecylphenol, dibutylphthalate, di-n-butyl sebacate, 2-hexyl-1-decanol, tri(2-ethylhexyl)phosphate, 2,4-di-t-pentylphenol, and triphenylphosphate.

11. The color photographic silver halide element of claim 1 having an ISO speed ratio less than 50.

12. The color photographic silver halide element of claim 1 having an ISO speed ratio less than 25.

13. A method of producing a color motion picture print film comprising:

A) imagewise exposing the color photographic silver halide element of claim 1 to form a latent color positive image, and B) processing the imagewise exposed element in an alkaline processing solution containing a color developing agent, to form a color positive image in a color motion picture print film.

14. The method of claim 13 wherein the imagewise exposing step is carried out using a laser imaging device.

15. The method of claim 13 comprising processing the imagewise exposed element using ECP-2D processing steps.

16. A color photographic silver halide element comprising a transparent support having an imaging side and a back side, and having on the imaging side thereof, in order:

one or more blue light sensitive layers, each blue light sensitive layer comprising gelatin or a gelatin derivative and junk consisting of all organic materials incorporated into such blue light sensitive layers other than gelatin or gelatin derivative and silver halide grains, one or more red light sensitive layers, each red light sensitive layer comprising gelatin or a gelatin derivative and junk consisting of all organic materials incorporated into such red light sensitive layers other than gelatin or gelatin derivative and silver halide grains, and green light sensitive layers, each green light sensitive layer comprising gelatin or a gelatin derivative and junk consisting of all organic materials incorporated into such green light sensitive layers and silver halide grains, provided that the total gelatin level of all blue, red, and green light sensitive layers on the imaging side of the support is less than 9000 mg/m$^2$, and the bulk gelatin-to-junk weight ratio for the total of all of the blue, red, and green light sensitive layers on the imaging side of the support is greater than 1.5, wherein the bulk gelatin-to-junk weight ratio is defined by the following equation:

$$\text{Bulk gelatin-to-junk ratio}=[(B_{gel}\times B_{gel/junk})+(R_{gel}\times R_{gel/junk})+(G_{gel}+G_{gel/junk})]\div(B_{gel}+R_{gel}+G_{gel})$$

wherein $B_{gel}$ is the total gelatin level for all of the one or more blue light sensitive layers, $B_{gel/junk}$ is the gelatin-to-junk ratio for all of the one or more blue light sensitive layers, $R_{gel}$ is the total gelatin level for all of the one or more red light sensitive layers, $R_{gel/junk}$ is the gelatin-to-junk ratio for all of the one or more red light sensitive layers, $G_{gel}$ is the total gelatin level for all of the one or more green light sensitive layers, and $G_{gel/junk}$ is the gelatin-to-junk ratio for all of the one or more green light sensitive layers.

* * * * *